US005375555A

United States Patent [19]

Dolan

[11] Patent Number: 5,375,555

[45] Date of Patent: Dec. 27, 1994

[54] NON-FURLING FLAG FASTENERS

[76] Inventor: George D. Dolan, 1110 Swallow Cir., Sugar Land, Tex. 77478

[21] Appl. No.: 957,267

[22] Filed: Oct. 6, 1992

[51] Int. Cl.[5] ..... G09F 17/00

[52] U.S. Cl. ..... 116/174

[58] Field of Search ..... 116/173, 174, 175; 52/720; 248/511, 521

[56] References Cited

U.S. PATENT DOCUMENTS

| | | | |
|---|---|---|---|
| 1,236,417 | 8/1917 | Finn | 116/174 |
| 1,306,915 | 6/1919 | Klamroth | 116/174 |
| 1,855,824 | 4/1932 | Crichton | 116/173 |
| 2,799,240 | 7/1957 | Andrews | 116/174 |
| 3,675,615 | 7/1972 | Stangarone et al. | 116/173 |
| 3,792,680 | 2/1974 | Allen | 116/173 |
| 3,952,695 | 4/1976 | Vollstedt | 116/173 |
| 4,452,167 | 6/1984 | Burroughs | 116/174 |
| 4,554,885 | 11/1985 | Burny, Jr. | 116/174 |
| 4,967,685 | 11/1990 | Beck | 116/174 X |

FOREIGN PATENT DOCUMENTS

| | | | |
|---|---|---|---|
| 0063529 | 1/1892 | Germany | 116/174 |
| 0621884 | 2/1981 | Switzerland | 116/174 |

*Primary Examiner*—William A. Cuchlinski, Jr.
*Assistant Examiner*—John L. Beres
*Attorney, Agent, or Firm*—Bush, Moseley & Riddle

[57] ABSTRACT

Assemblies for fastening the upper and lower inner corners of a flag to its supporting pole in a manner that prevent furling. Each assembly includes the combination of a swivel that is positioned longitudinally on the pole by a set screw, each swivel including an outwardly extending flange or ring member with a hole near an outer edge thereof. An inner ring member attached through such hole and lies in one plane, and an outer ring member is linked to the inner ring member and through a grommet near an adjacent inner corner of the flag. The outer ring member lies in a plane that is substantially orthogonal to the inner ring as the flag flies in the wind.

11 Claims, 1 Drawing Sheet

FIG. 1
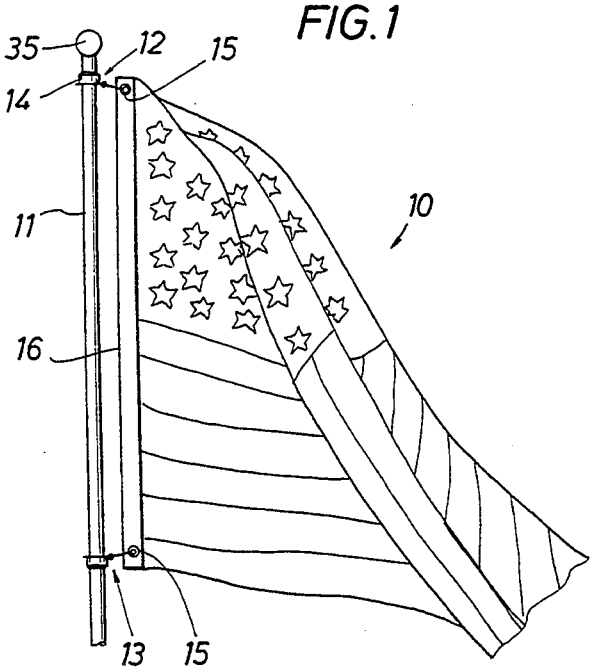
FIG. 3
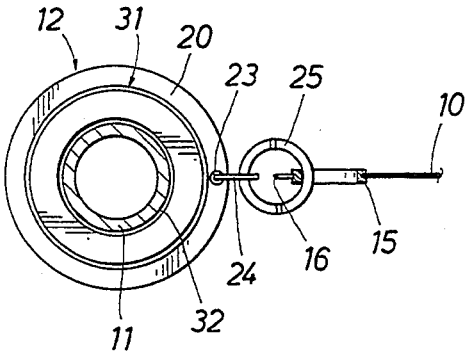
FIG. 4
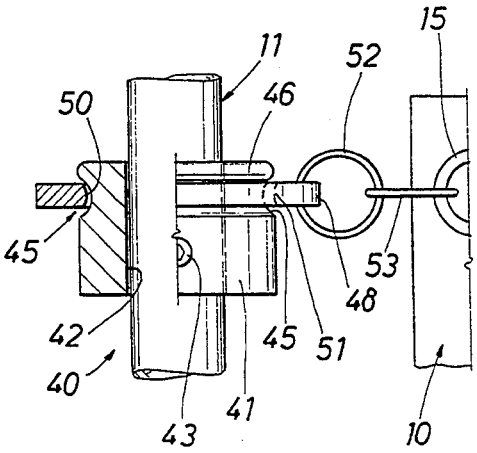
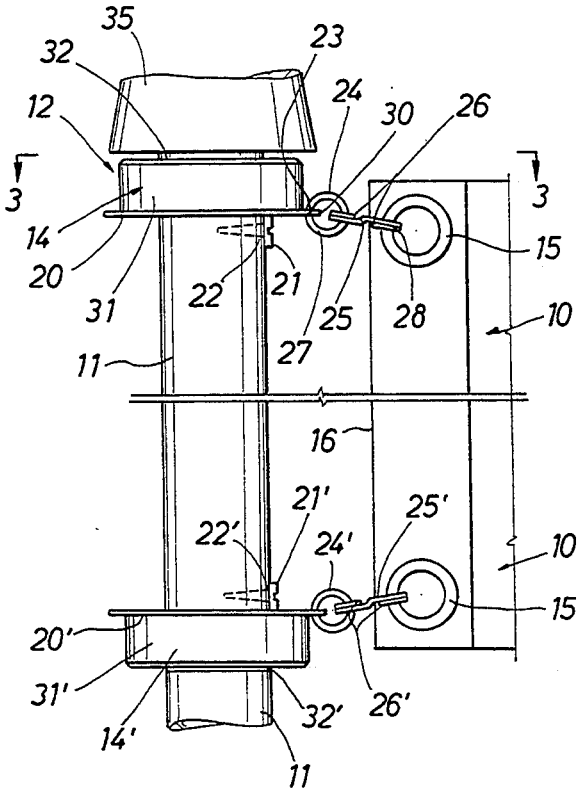
FIG. 2

NON-FURLING FLAG FASTENERS

FIELD OF THE INVENTION

This invention relates generally to fasteners for attaching a flag to a pole in a manner such that the flag will not wrap partially or totally around the adjacent section of the pole in response to changes in the wind, and particularly to a unique combination of swivels and fastener rings by which the grommets at the inner corners of a flag are attached to the pole in a manner which prevents any furling on account of the wind.

BACKGROUND OF THE INVENTION

When a flag that is flying in the wind experiences sudden changes in wind direction and/or velocity, all or part of the flag may tend to wrap around the pole in an undesirable manner. Not only is a tangled flag unsightly, but in some cases the flag must be taken down from the pole to unfurl it, and then raised again so that it will fly in a proper manner. Various efforts have been made to solve the furling problem, however to applicant's knowledge none of them have achieved any widespread use or commercial success. For example U.S. Pat. Nos. 756,989, 1,306,915, 1,554,758 and 5,044,301 disclose various forms of rigid, rotatable cages that mount the flag on bearings to prevent furling. However these mechanisms are complicated, heavy and expensive to make, and therefore are not particularly desirable to purchase or use. U.S. Pat. Nos. 689,077 and 2,672,118 show swivels mounted on a pole which cooperate with the ends a halyard by which the flag is raised and lowered. These devices also appear to be quite expensive to make and cumbersome to install, particularly on a very tall pole where a halyard typically is used. U.S. Pat. No. 2,799,240 shows rigid wire clips that extend around split rings that are mounted on the pole, or in grooves thereon, as well as bearing-mounted arms and pulleys that are used with a halyard. Hereagain the devices disclosed by this patent are complicated and would be very expensive to manufacture, as well as difficult to install on a pole.

The general object of the present invention is to provide new and improved no-furl fasteners between the inner comers of a flag and its pole which obviate the foregoing and other problems in this art.

SUMMARY OF THE INVENTION

This and other objects are attained in accordance with the concepts of the present invention through the provision of fastener assemblies for securing the respective upper and lower corners of a flag to its pole, the assemblies each including a pair of orthogonally arranged, linked rings, one of which is attached to a swivel means that is adjustably mounted on the pole, and the other of which passes through a grommet in an inner corner of the flag. The combination of rings and swivels positively prevents any furling of the flag in response to the comings and goings of the wind, are inexpensive to make, and extremely easy to install.

BRIEF DESCRIPTION OF THE DRAWINGS

The present invention has other objects, features and advantages which will become more clearly readily apparent in connection with the following description of a preferred embodiment, taken in conjunction with the appended drawings in which:

FIG. 1 is a general elevational view of a flying flag that is fastened to the pole in accordance with this invention;

FIG. 2 is an enlarged side view showing both the upper and lower fastener assemblies;

FIG. 3 is a top view of one of the fastener assemblies; and

FIG. 4 is a side view, partly in section and partly in elevation of an alternative embodiment.

DETAILED DESCRIPTION OF PREFERRED EMBODIMENTS

Referring initially to FIG. 1, a flag 10 is shown mounted on a pole 11 by an upper assembly 12 and a lower assembly 13 which are constructed in accordance with the present invention. Each assembly includes a swivel 14 which is positioned at a selected level on the pole 11, with one assembly being arranged as the inverted mirror image of the other. The flag 10 has the usual grommet 15 near each of its inner corners, and the assemblies 12, 13 preferably are spaced apart by a distance such that the inner edge 16 of the flag has no substantial slack therein.

As shown in FIG. 2, the upper assembly 12 includes a suitable swivel 14, for example a ball bearing, which has an inner sleeve 32 with a diameter sized such that it slips on and slides easily along the pole 11. The swivel 14 has an outwardly directed flange 20 on its lower side, and a set screw 21 or the like is fastened in a hole 22 in the pole 11 below the flange 20 to prevent downward movement of the swivel along the pole. The flange 20 has a hole 23 near a peripheral outer edge thereof through which a first, preferably circular ring member 24 passes in a manner such that it is oriented in a vertical plane. The ring member 24 can be a split type with abutting ends 27. A second ring member 25, also preferably circular, is looped through the inner ring member 24 as well as through the grommet 15. The ring 25 can be the type of ring that is formed with upper and lower coils that extend from split ends 26. The arrangement of the inner and outer ring members 24 and 25 is such that under lateral forces, the outer ring member stands outward in a plane that is orthogonal, or at a right angle, to the plane of the inner ring member 24. The ring member 24 typically has sufficient resilience that it can be easily opened by hand and placed through the hole 23 in the flange 20, whereupon the ends 27 close against one another to prevent release. The outer ring member 25 can be like a car-key ring in that its loops can be temporarily spread apart adjacent one end of a coil to enable its insertion through the grommet 15. Although the members 24 and 25 are shown in a preferred circular form, other shapes could be used so long as they each define a closed perimeter or boundary which permits them to be linked together as shown in FIGS. 2–4. For larger flag and pole applications, the outer ring member 25 can be a quick-link device. Although the inner ring member 24 is shown as having a diameter that is about one-half the diameter of the outer ring member 25, other relationships of diameter can be used. Both of the ring members 24, 25 preferably are made of a corrosion resistant metal, or a metal that has been coated for corrosion resistance.

Although the swivel 14 can take various other forms, such as that shown in FIG. 4, one suitable swivel is a ball bearing assembly having a plurality of balls that ride between upper and lower races in a housing 31. The assembly can be lubricated to provide trouble-free swivel motion for an extended period of time. The swivel 14 includes the inner sleeve 32 that is sized to fit somewhat loosely, that is without close tolerance, around the pole 11 so that the swivel can easily be slipped therealong. The flange 20 is preferably located on the lower side of the housing 31 of the upper assembly 12, so that the stop screw 21 does not bind against the housing and impede free rotation. A suitable ornament 35 can be positioned atop the pole 11, in the usual fashion. The upper side of the upper swivel housing 31 can be positioned closely adjacent to the lower end of the ornament 35 so that the upper assembly 12 is essentially fixed longitudinally between the ornament and the upper stop screw 21.

The lower fastener assembly 13 is constructed identically to the upper assembly 12, but its swivel 14 and set screw 21' are oriented opposite to that of the upper assembly so that its flange and set screw are on its upper side. Parts of the lower assembly 13 that are like those of the upper assembly 12 are given the same number, but with a prime notation Another embodiment of the present invention which employs a different swivel and flange arrangement is shown in FIG. 4. Here the swivel 40 includes a generally tubular body 41 having an internal bore 42 that is sized to slide relatively easy along the pole 11. A set screw 43 which is threaded into a radial hole 44 in the body 41 and into gripping engagement with an outer surface of the pole 11 is used to fix the body to the pole. An external annular groove 45 which preferably has concave wall surfaces 45' is formed on the upper portion of the body 41, having a rim 46 at the top. A flange or ring 48 is loosely received in the groove 45 and has a convex inner wall surface 50 with a minimum diameter that is slightly smaller than the outermost diameter of the rim 46 so that the flange is pressed over the rim and into the groove 45 during assembly. As shown, there is a substantial amount of lateral clearance between the flange 48 and its groove 45 so that the flange can tilt somewhat with respect to the longitudinal axis of the body 41.

The flange 48 has an axial hole 51 on one side thereof through which an inner ring 52 extends. An outer ring 53 extends through the grommet 15 and through the inner ring 52, as in the previous embodiment. The rings 52, 53 lie in orthogonal planes due to outward force as the flag 10 flies in the wind. Like the previous embodiment, a lower fastener assembly (not shown) identical to that illustrated in FIG. 4 is fixed to the pole by a set screw adjacent the lower inner corner of the flag 10, but in the inverted mirror image thereof. Such mounting has the advantage that outward forces on the rings 52, 53 and the flanges 48 as the flag 10 flies tend to tilt the planes of the respective flanges relatively toward one another, such tilting being permitted by their clearances with respective grooves 45. Thus neither one of the flanges 48 is likely to ever be forced out of its groove 45 by the wind.

The body 41 and the flange 48 of each assembly preferably are made of ultra-high molecular weight polyethylene which has high lubricity and thermally stability. Such plastic is long lasting and ultraviolet resistant, and rain water even improves the lubricity. Although in the embodiment shown in FIG. 4 each of the flanges 48 is temporarily expanded as it is pressed over a rim 46 so that it interfits with the groove 45, the rim and the upper part of the groove could be formed as a separate piece that is threaded or otherwise secured to the lower part of the body 41. In this case the flange 48 could be placed in its groove prior to assembly of the body sections.

OPERATION

In use of the embodiment shown in FIG. 2, the lower and upper swivels 14, 14' are slid onto the pole 11 and longitudinally spaced with respect to the distance between the grommets 15 at the inner corners of the flag 10. As noted previously the upper swivel 14 preferably is arranged with its flange 20 on the lower side, and the lower swivel 14' is oriented so that its flange 20' is on the upper side. Then the set screw holes 22 and 22' are marked and drilled, and the screws 21, 21' secured in the holes. The outer rings 25, 25' are passed through the respective grommets 15, and the inner rings 24, 24' are connected through both the rings 25, 25' and the holes 23, 23' in the flanges 20, 20'. The lower set screw 21' also bears against the flange 20' rather than the housing 31' to reduce binding. The inverted mirror image relationship of the assemblies 12 and 13 enables the set screws 21, 21' to prevent movement of the respective swivels relatively toward each other, and the upper set screw 21, together with the inner side of the flag 10 and the lower rings 24' and 25' prevent downward movement of both of the assemblies 12 and 13. In like manner the lower set screw 21', the lower rings 24', 25', the inner side of the flag 10 and the upper ring members 24, 25 prevent upward, or outward movement of both assemblies 12, 13 along the pole 11. Upward movement of the upper fastener assembly 12 also is prevented by the ornament 35, when used.

In the event the flag 10 tries to furl either partly or totally around the pole 11, the fastener assemblies 12, 13 will rotate relative to the pole and either prevent such furling from occurring, or immediately releasing any furling through relative rotation. The respective inner rings 24, 24' and the respective outer rings 25, 25' always occupy an orthogonal relationship to one another any time that the flag 10 flies in response to the wind. When the pole 11 is one that stands upright as shown in FIG. 1, the inner rings 24, 24' will lie in a vertical plane, and the outer rings 25, 25' will lie in substantially the horizontal. Where the pole 11 is tilted at an angle to the vertical, the orthogonal position of the rings 24, 24' and 25, 25' still is maintained.

The embodiment shown in FIG. 4 operate in substantially the same way, except that the bodies 41 of the swivels are fixed to the pole 11 by the set screws 43, and the flanges or rings 48 and the inner and outer rings 52, 53 rotate relative to the pole to prevent or release furling. Hereagain the tings 52, 53 lie in orthogonal planes under force of the wind.

It now will be recognized that new and improved flag fasteners have been disclosed which are extremely easy to assemble on the pole and connect to the inner corners of a flag. The assemblies are economically attractive to make, and effective to prevent furl. Although a double coil split ring has been disclosed in the first embodiment as the outer link to the grommet, a light-weight snap hook with an eye on its inner end also can be used, or a quick-link ring. Thus since certain changes or modifications may be made in the disclosed embodiments without departing from the inventive concepts involved, it is the aim of the appended claims to cover all such changes and modifications that fall within the true spirit and scope of the present invention.

What is claimed is:

1. An assembly for fastening an inner corner portion of a flag to a supporting pole in a manner such that furling of said flag is prevented, said corner portion having a grommet to protect an opening through the material of which said flag is made, comprising: swivel means mounted on the pole adjacent such corner portion, said swivel means including an outwardly extending member with an axial hole formed therethrough; first link means having an open interior and a closed perimeter and being adapted to pass through the grommet and extending inward toward said swivel means, said first link means lying in a first plane when the flag flies in response to the wind; and second link means having an open interior and a closed perimeter and being connected to said first link means and to said hole, said second link means lying in a second plane that is substantially orthogonal to said first plane when the flag flies in response to the wind.

2. The assembly of claim 1 wherein each of said first and second link means is a ring member having means to allow linking the other ring member thereto.

3. The assembly of claim 1 wherein said outwardly extending member is an annular flange that is mounted to said swivel means.

4. The assembly of claim 1 further including stop means for positioning said swivel means at a selected location on the pole.

5. The assembly of claim 4 wherein said stop means is a set screw adapted to be engaged in an aperture in the pole.

6. The assembly of claim 5 wherein said swivel means is oriented on the pole such that said set screw is positioned adjacent said flange.

7. The assembly of claim 1 wherein said swivel means includes a generally tubular body having an external annular groove formed adjacent one end thereof, said outwardly extending member being an annular flange that is mounted loosely in said groove.

8. The assembly of claim 7 wherein said body has a rim at one end adjacent said groove, said flange having an internal diameter that is slightly smaller than the external diameter of said rim.

9. The assembly of claim 7 further includes set screw means for fixing said body against rotation relative to the pole.

10. Upper and lower assemblies for use in fastening grommets at the respective inner corner portions of a flag to a supporting pole in a manner such that furling of said flag in response to wind action is prevented, each of said corner portions having a grommet to protect an opening through the material of which said flag is made, each of said assemblies comprising: swivel means adapted to be mounted on the pole adjacent each of such portions, each of said swivel means having an outwardly extending means with an axial hole formed therein; first link means having an open interior and a closed perimeter and being adapted to pass through a respective one of said grommets and extending inward toward an adjacent one of said swivel means, said first link means each lying in a first plane when the flag flies in response to the wind; and second link means having an open interior and a closed perimeter and being adapted to be connected to a respective one of said first link means and to a respective one of said holes, said second link means each lying in a second plane that is substantially orthogonal to said first plane when the flag flies in response to the wind.

11. The assemblies of claim 10 wherein said swivel means are oppositely oriented on the pole, and further including stop means fixed to the pole adjacent each of said swivel means and engaging the same for fixing the longitudinal position of the flag on the pole.

* * * * *